US005219070A

United States Patent [19]

Grunert et al.

[11] Patent Number: 5,219,070

[45] Date of Patent: Jun. 15, 1993

[54] LOCKABLE ROTARY HANDLE OPERATOR FOR CIRCUIT BREAKER

[75] Inventors: Kurt A. Grunert; Ronald J. Price, both of Beaver; Ronald A. Cheski, Stowe Township, Allegheny County; Ronald D. Smiddle, Canonsburg, all of Pa.

[73] Assignee: Westinghouse Electric Corp., Pittsburgh, Pa.

[21] Appl. No.: 729,084

[22] Filed: Jul. 12, 1991

[51] Int. Cl.[5] ..... H01H 3/20

[52] U.S. Cl. ..... 200/330; 200/332; 200/43.001; 200/43.011

[58] Field of Search ..... 200/330, 332, 336, 43.01, 200/43.11, 43.14, 43.15, 43.16, 43.19, 43.21, 43.22, 529, 553, 564, 572

[56] References Cited

U.S. PATENT DOCUMENTS 2,368,083 1/1945 Adam ..... 200/330
3,171,908 3/1965 Malota ..... 200/330

OTHER PUBLICATIONS

Westinghouse Quick Selector Catalog, Electrical Components Division, Disconnect Switches Visi-Flex De-Ion Type, Sep. 1989, p. 88.
Westinghouse Quick Selector Catalog, Electrical Components Division, Handle Mechanisms Vari-Depth Type, Sep. 1989, p. 90.

*Primary Examiner*—Henry J. Recla
*Assistant Examiner*—David J. Walczak
*Attorney, Agent, or Firm*—M. J. Moran

[57] ABSTRACT

A rotary handle operator for a circuit breaker with a linearly movable handle has a housing which is mounted over the circuit breaker handle. A slide carrying a rack engages the circuit breaker handle and is slidable within a chamber in the housing. The rack engages a pinion gear sector mounted on a rotatable shaft which extends through a cover on the housing. A rotating handle mounted on the shaft is rotated to linearly operate the circuit breaker handle or is positioned thereby when the circuit breaker trips. The handle may be locked in the off position by inserting the shackle of a lock through an aperture in a lever arm on the rotating handle to urge a pin on a spring biased locking piece within the handle lever into an aperture in the housing cover, or the shackles of several locks may engage a slot in a shroud surrounding the rotating handle to interfere with rotation of the handle out of the off position. An interlock for the door of a cabinet in which the circuit breaker may be mounted is incorporated into the rotary door operator.

30 Claims, 7 Drawing Sheets

FIG. 2
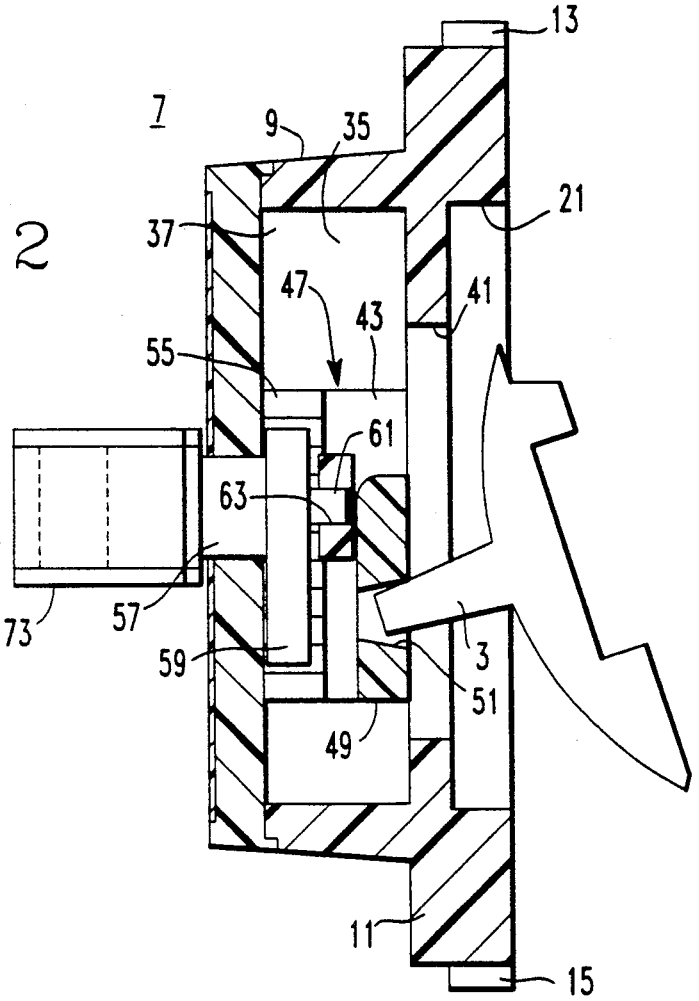
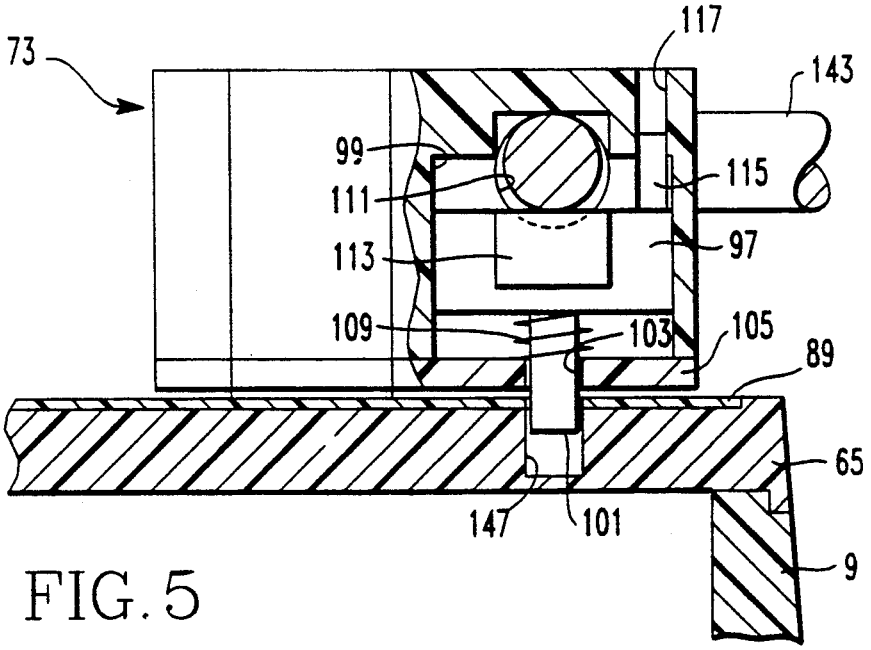
FIG. 5

LOCKABLE ROTARY HANDLE OPERATOR FOR CIRCUIT BREAKER

BACKGROUND OF INVENTION

1. Field of Invention

This invention relates to handle operators which provide an interface and additional electrical isolation between the handle of a circuit breaker mounted behind a panel or behind a door in a cabinet, and the person operating the breaker. It also relates to such a handle operator which converts the linear motion of the circuit breaker handle, to rotary motion, and which can lock the circuit breaker in the off position.

2. Background Information

A common type of circuit breaker has a handle which moves linearly between an on and an off position. The handle is connected to the movable contacts of the circuit breaker through a spring powered, over center toggle device which trips the contacts open and moves the handle to an intermediate position in response to certain overcurrent conditions.

In some installations, the circuit breakers are mounted behind a panel or behind a door in a cabinet. Typically in these installations, the handles of the circuit breakers protrude through openings in the panel or door and are operated directly. In some applications, it has been deemed desirable to provide an interface between the handle and the person operating the breaker. These interfaces have for the most part constituted pivoted metal form structures such as a pivoted plate connected to a rotatable handle. Typically, these pivoted metal form structures are spring biased, such as toward the off position. Often, the spring serves as the driving connection between the circuit breaker handle and the rotating handle.

Performance of these interfaces with rotating handles has not always been satisfactory. Typically, they have substantial mass which loads up the over center toggle device of the breaker. The spring force of the toggle device is generally weakest at the trip position, and the additional loading imposed by the pivoted metal from structures of the existing rotary operators has made it difficult to position the handles at the trip position. While tripping of the circuit breaker is not adversely affected, accurate positioning of the handle is necessary to provide a visual indication of the tripped condition of the circuit breaker.

Some of the known rotating handle operators can be locked in the off position. However, in some instances, this can be done even though the contacts of the circuit breaker have become welded closed. While this condition was made possible by the internal structure of some circuit breakers, such breakers have in many instances been modified to prevent even moving the circuit breaker handle to the off position when the contacts are welded closed. Despite these modifications, a rotary handle connected to the circuit breaker handle through a spring could still be moved to, and locked in, the off position to provide a false indication of the state of the circuit breaker when the contacts are welded closed.

There remains a need therefore for an improved circuit breaker handle operator, and especially an improved rotating handle operator.

There is a more particular need for an improved handle operator which does not load up the spring of the toggle device of the circuit breaker, and preferably one which does not require a biasing spring.

There is also a need for an improved handle operator which can provide an accurate indication of the state of the circuit breaker even when the circuit breaker contacts are welded closed.

There is an additional need for such an improved handle operator which can be locked in the off position.

There is still another need for such an improved handle operator which can seal out dust and moisture from a circuit breaker mounted in a cabinet.

There is yet another need for such an improved handle operator which incorporates an interlock for the door of a cabinet in which the circuit breaker is mounted.

SUMMARY OF THE INVENTION

These and other needs are satisfied by the invention which is directed to a rotary handle operator used in conjunction with a circuit breaker with a linearly movable operating handle.

The rotary handle operator includes a housing which is mounted on the front of the circuit breaker over the linearly movable operating handle. A slide member engaging the operating handle is movable along a linear path within the housing. The slide member incorporates a rack extending along the linear path. A rotating member mounted in the housing for rotational movement is connected to the slide by a pinion gear sector engaging the rack. A rotating handle is connected to the shaft, so that rotation of the rotating handle produces linear motion of the circuit breaker handle, and linear motion of the circuit breaker handles such as when the circuit breaker trips rotates the rotating handle.

As another aspect of the invention, a locking device is provided for the rotating handle which includes a radially extending lever portion. In one embodiment of the invention, a spring loaded locking device in the lever portion of the handle is deflected by the shackle of a padlock inserted through apertures in the handle to extend a projection which engages the housing of the rotary handle operator to prevent movement of the rotary handle, and therefore the circuit breaker handle.

In another embodiment of the invention, a shroud, which at least partially surrounds the rotating handle, has an enclosed slot through which the shackle of one or more locks extends to interfere with rotation of the rotary handle. Preferably, both locking mechanisms lock the rotating handle, and therefore, the circuit breaker handle, in the off position.

The rotary handle operator of the invention also preferably includes an interlock which must be actuated to open a cabinet door behind which the circuit breaker is mounted with the rotary handle operator extending through an opening in the door.

BRIEF DESCRIPTION OF THE DRAWINGS

A full understanding of the invention can be gained from the following description of the preferred embodiments when read in conjunction with the accompanying drawings in which:

FIG. 2 is a side elevation view of the rotary handle operator of FIG. 1 shown in section and interconnected with the circuit breaker handle.

FIG. 5 is a fragmentary vertical, sectional view through the handle of FIG. 4 with the handle shown padlocked in the off position.

DESCRIPTION OF THE PREFERRED EMBODIMENT

Figure 1:
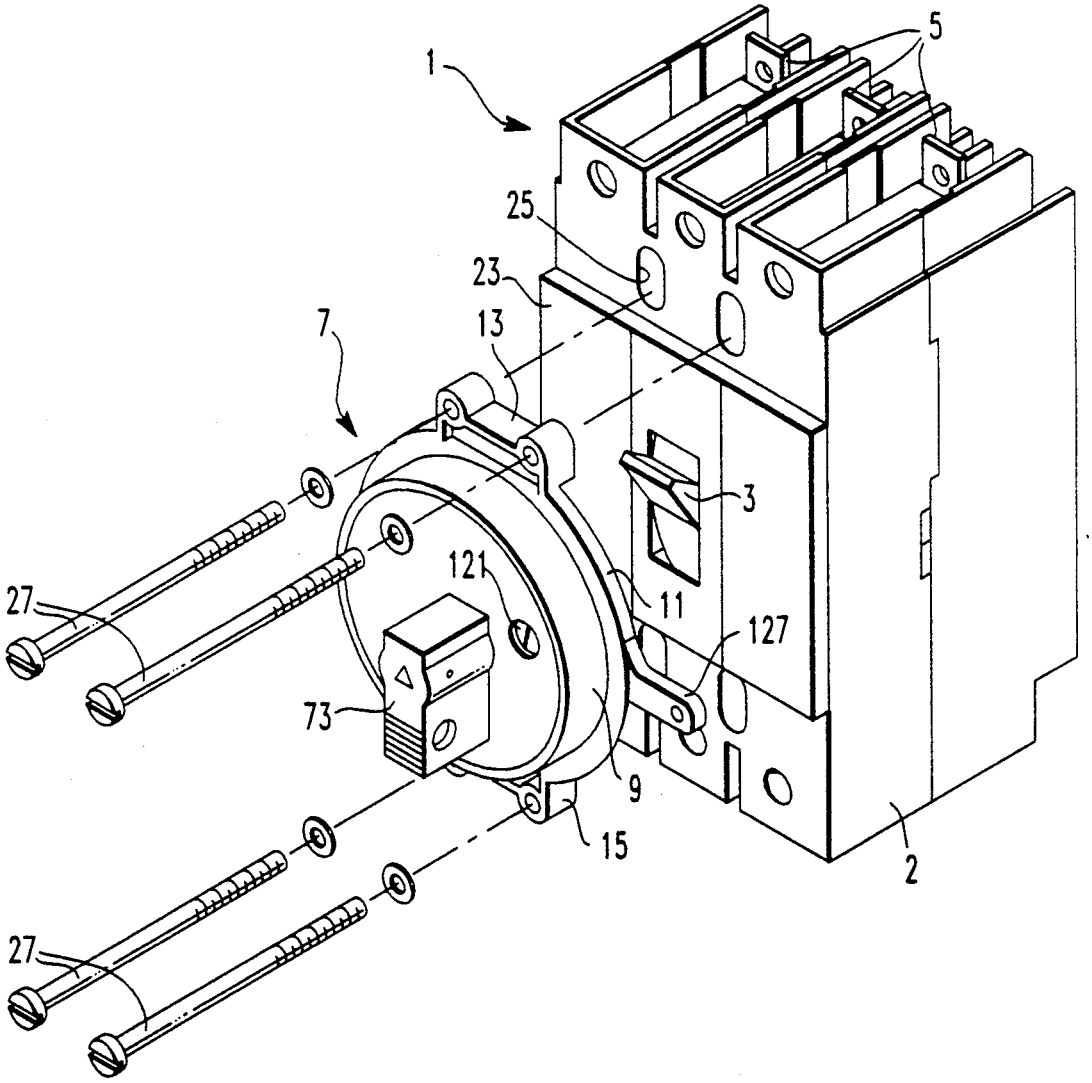
FIG. 1 is an isometric view of a rotary handle operator in accordance with the invention shown in position for mounting on a circuit breaker.

Referring to FIG. 1, the invention is applied to a molded case circuit breaker 1. While the exemplary circuit beaker 1 is a three phase breaker, the invention is applicable to any breaker having a linearly movable handle 3. With the handle 3 in the raised position, as shown, the well-known internal mechanism of the breaker closes electrical contacts (not shown) to complete a circuit between three phase line terminals 5 on top of the exemplary breaker and load terminals (not visible) similarly located at the bottom of the breaker. When the handle 3 is moved down to an off position, the electrical contacts are opened to interrupt the circuit between the line and load terminals. Under certain current overload conditions, the circuit breaker trips to open the contacts, and the handle 3 is positioned to an intermediate trip position just above the off position. To reset the tripped breaker, the handle 3 is pressed downward slightly below the off position. The handle can then be returned to the on position to reclose the contacts.

As indicated previously, typically, the circuit beaker 1 is mounted behind a panel which in many instances is behind a door in a cabinet. Often it is desirable to have an interface through which the circuit breaker can be operated for additional electrical isolation and/or providing a moisture proof seal for the breaker which is typically not sealed tightly around the handle 3. It is also desirable in some installations to have a rotary operating handle rather than a linearly movable handle for the interface.

Figure 3:
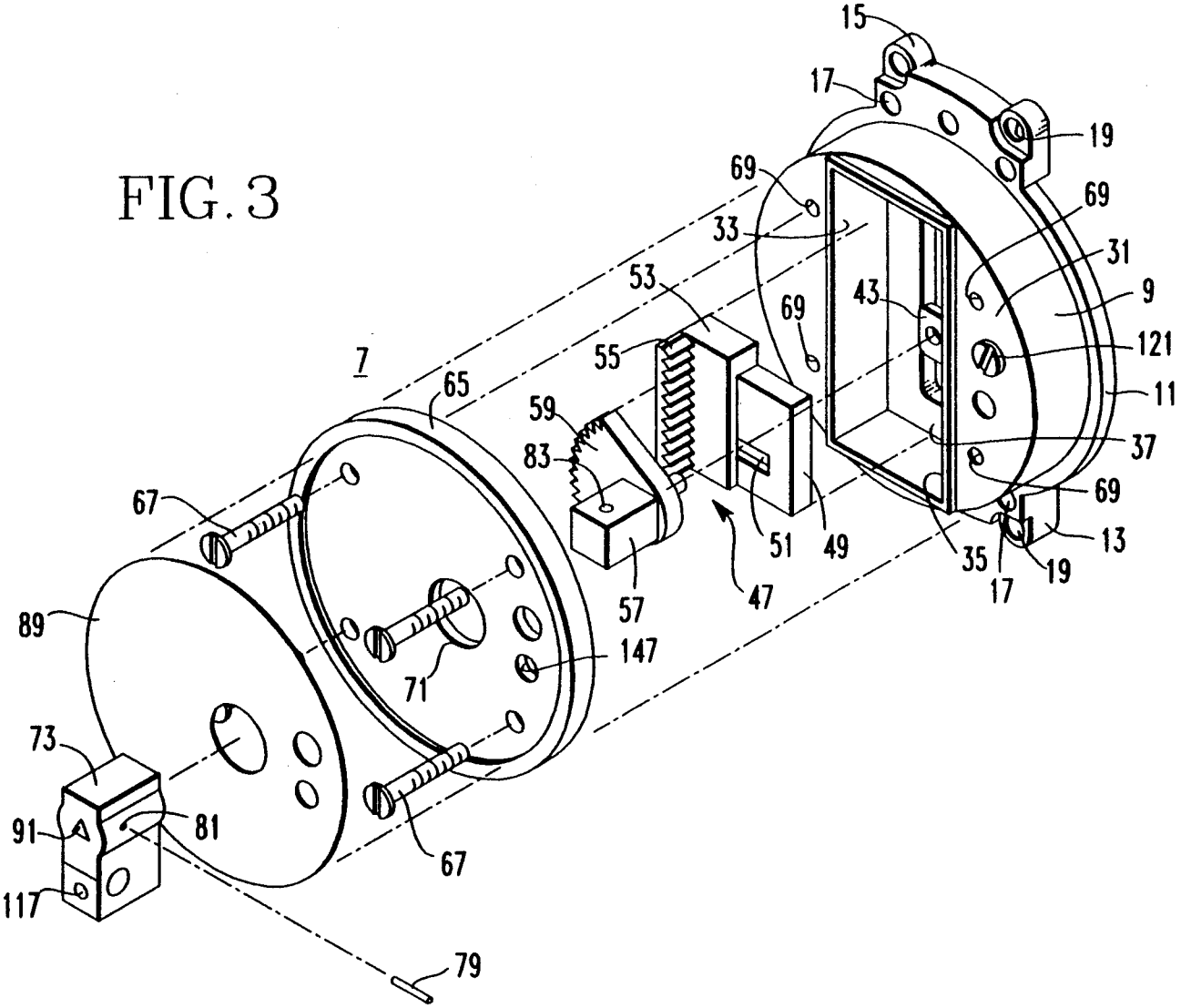
FIG. 3 is an exploded isometric view of the rotary handle operator of FIGS. 1 and 2.
Figure 6:
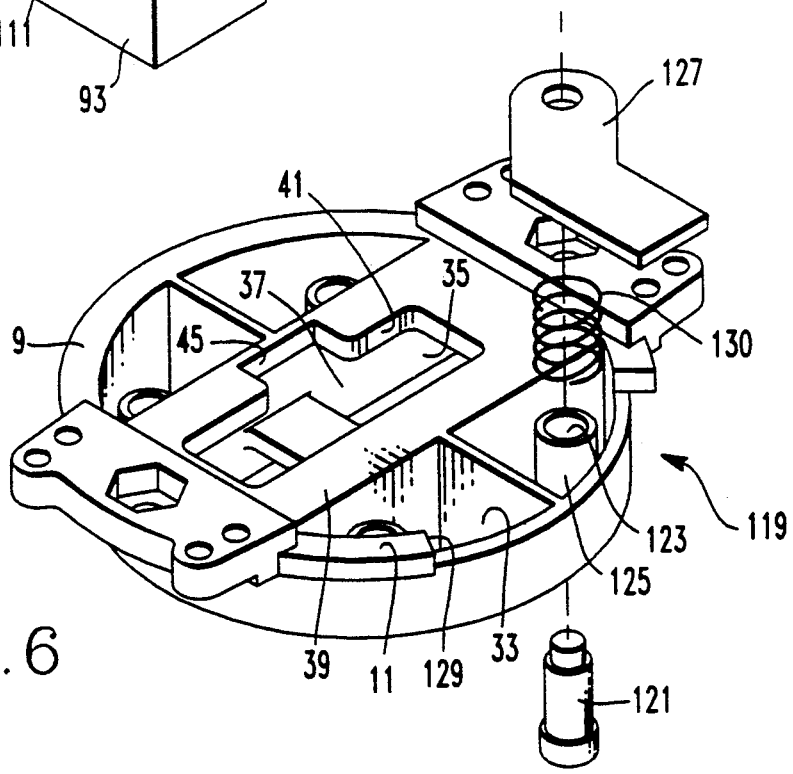
FIG. 6 is an isometric exploded view illustrating the interlock mechanism of the rotary handle operator of FIGS. 1 through 5.

The rotary handle operator 7 fulfills all of these requirements. As shown assembled in FIGS. 1 and 2, and exploded in FIGS. 3, 4 and 6, the rotary handle operator 7 includes a molded cylindrical housing 9 having an annular flange 11 at one end and radial mounting flanges 13 and 15 at the top and bottom, each with two pairs of holes 17 and 19. The mounting flanges 13 and 15 extend axially beyond the radial flange 11 and form a transverse slot 21 (see FIG. 2). When the housing 9 is mounted on the front of the circuit breaker 1 centered over the handle 3, the slot 21 accommodates the raised horizontal center section 23 on the front of the circuit breaker 1 and the pairs of mounting holes 17 and 19 are aligned with vertical slots 25 in the circuit breaker cover. The slots 25 each contain two threaded holes (not shown) one aligned with a hole 17 and the other with a hole 19. The threaded holes in slots 25 aligned with the holes 17 receive bolts (not shown) which secure the cover of the molded case circuit breaker 2 to a base. If these bolts are removed and passed through the holes 17, the rotary handle operator 7 is secured to the circuit breaker 1 to form a unit. Bolts 27 are passed through the holes 19 and screwed into the other threaded holes in the slots 25 to secure the circuit breaker 1 and rotary handle operator 7 to a mounting panel.

The housing 9 has a circular front wall 31. This front wall 31 and two internal, axially extending chordal walls 33 and 35 form a generally rectangular chamber 37 inside the housing 9. The rear of the chamber 37 is partially closed by a rear wall 39 having an elongated opening 41 (see FIG. 6). A flange 43 projects laterally from the chordal wall 33 half way between the front wall 31 and rear wall 39. The opening 41 has a transverse extension 45 aligned with the projection 43 to accommodate molding of this member.

A slide member 47 is slidable longitudinally in the chamber 37. This slide member 47 is generally rectangular and has a base section 49 with a transverse slot 51 therein, an intermediate raised portion 53, and a rack 55 extending transverse to the plane of the slide member along a side edge. The slide member 47 is slidable longitudinally in the chamber 37 with the base portion 49 extending under the projections 43. A rotating member in the form of a square shaft 57 is concentrically mounted on a pinion gear sector 59. A concentrically mounted pivot pin 61 on the pinion gear section 59 is rotatably received in a bore 63 in the flange 43. With the pivot pin 61 mounted in the flange 43, the pinion gear sector engages the rack 55 to provide a connection between the rotating member 57 and the slide member 47.

The rotary handle operator 7 further includes a circular cover 65 which is secured to the housing 9 by four screws 67 which are received in threaded apertures 69 in front wall 31 of the housing 9. The cover 65 has an aperture 71 through which the square rotating shaft 57 projects.

Figure 4:
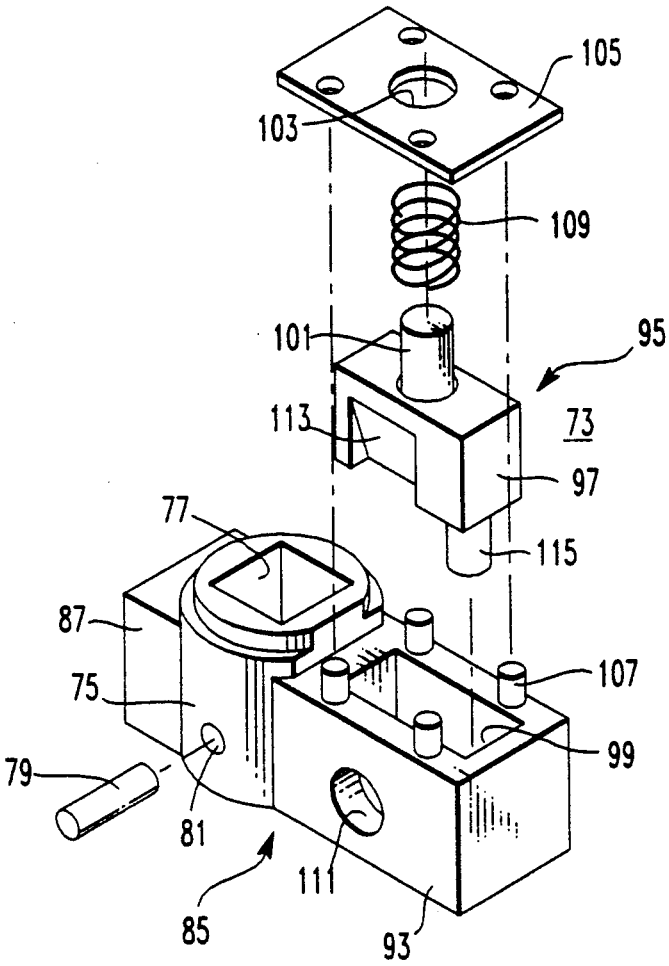
FIG. 4 is an exploded isometric view of the handle of the rotary handle operator of the previous figures illustrating the locking mechanism.

A rotating handle 73, shown upside down in the exploded isometric view of FIG. 4, has a cylindrical hub 75 which in turn has a square, longitudinally extending bore 77 in which the square shaft 57 is received. A locking pin 79 extends through a transverse bore 81 in the cylindrical hub 75 and into a transverse bore 83 in the square shaft 57 to fix the rotating handle 73 on the shaft 57 (see FIG. 3).

The rotating handle 73 further includes an elongated generally rectangular lever 85 extending radially from the cylindrical hub 75. A short end 87 of the lever arm 85 serves as a pointer to indicate the state of the circuit breaker as embossed on a face plate 89 secured to the cover 65 of the housing 9. An embossed arrow 91 on the end of the cylindrical hub 75 further points to the state of the circuit breaker. The long portion 93 of the lever arm 85 houses a locking mechanism 95. The locking mechanism 95 includes a lock piece 97 which slides in a slot 99 in the long portion 93 of the lever arm 85. A locking pin 101 extending from the locking piece 97 registers with an aperture 103 in a cover plate 105 secured to the bottom of the lever arm 85 over the slot 99 by a number of molded pins 107. A helical compression spring 109 surrounding the locking pin 101 biases the locking piece 97 upward in the slot 99 into register with a transverse bore 111 through the lever arm 85. An inclined groove 113 in the locking piece 97 forms a camming surface aligned with the transverse bore 111 with the locking piece 97 biased to the raised position. A guide pin 115 on the locking piece 97 extends into a bore 117 in the face of the lever arm 85.

In installations where the circuit breaker is mounted behind a door in a cabinet, the rotary handle operator 7 of the invention includes an interlock 119 which requires a conscience operation by personnel to unlatch the door to remind them that they are exposing themselves to electrical apparatus. The interlock device 119 includes a pin 121 extending through a bore 123 in an axially extending boss 125 molded in the housing 9 (see FIG. 5). A locking lever 127 is threaded onto the end of the pin 121 and is rotatable with the pin 121 in a slot 129 in the flange 11 of the housing 9. A helical torsion spring 130 surrounding the boss 125 engages the locking lever 127 and biases it against one end of the slot 129.

In operation, the rotary handle operator 7 is mounted on the front of circuit breaker 1 either before or concurrently with the mounting of the breaker on the panel 29. With the circuit breaker handle 3 in the on position, the slide member 47 is in the raised position within the chamber 37 and the rotating handle 73 is vertical. If it is desired to turn the circuit breaker off, the handle 73 is rotated counter-clockwise. This rotates the pinion gear sector 59 which through engagement with the rack 55 lowers the slide member 47 carrying with it the circuit breaker handle 3. As the rotating handle 73 reaches the horizontal position, the handle 3 of the circuit is moved down sufficiently to toggle the circuit breaker contacts open. If it is desired to lock the circuit breaker 1 in the off position, the shackle 143 of a lock is inserted into the transverse bore 111 in the lever arm 85 of the rotating handle 73 as shown in FIG. 5. The end of the shackle bears against the camming surface of the slot 113 in the locking piece 97 to push the locking piece downward against the bias of the spring 109. This causes the locking pin 101 to extend through the aperture 103 in the cover plate 105 and into an aperture 147 in the circular cover 65 on the housing 9 to prevent movement of the rotating handle 73, and therefore, the circuit breaker handle 3 out of the off position without removal of the lock. If the shackle has a blunt end, deflection of the locking piece 97 can be aided by depressing the guide pin 115.

If the circuit breaker trips, the internal mechanism of the breaker will move the circuit breaker handle 3 from the on position to the intermediate, tripped position. As the circuit breaker handle 3 is engaged by the slide member 47 in the rotary handle operator 7, the rotary handle 73 will also be moved to the trip position through the rotation of the pinion gear sector 59 by the rack 55 on the slide member 47. The circuit breaker is then reset by rotating the rotating handle 73 further counter-clockwise slightly past the off position to the reset position, to move the circuit breaker handle all the way down to the reset position below the off position.

The rotating handle operator housing 9, slide member 47 with its rack 55, the pinion gear sector 59, the rotating shaft 57 and the rotating handle 73 are all made of light weight resin material having a low coefficient of friction. While various types of resin materials meeting these criteria could be used, the components of the exemplary rotary handle operator were made from Valox resin. In addition, these components of the rotary handle operator are sized such that the moment created by the slide member 47 is slightly greater than the moment created by the rotating handle 73, such that the mechanism is biased towards the off position. This balancing of the components, and the low friction of the resinous materials used, imposes very little loading on the spring powered trip mechanism within the circuit breaker so that the circuit breaker handle 3, and therefore, the rotating handle 73 are accurately positioned when the circuit breaker 1 trips.

Figure 7:
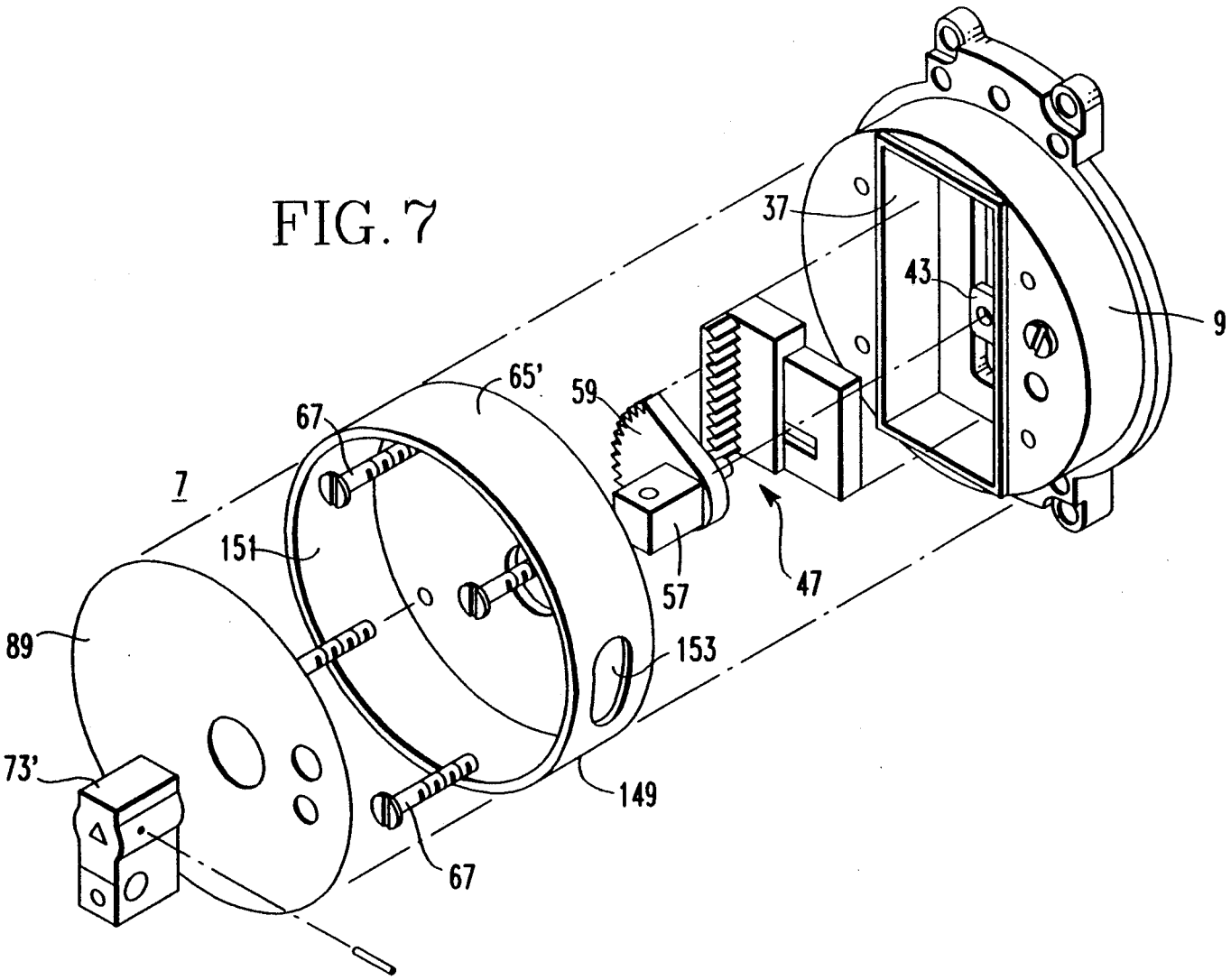
FIG. 7 is an isometric exploded view of another embodiment of a rotary handle operator in accordance with the invention.
Figure 8:
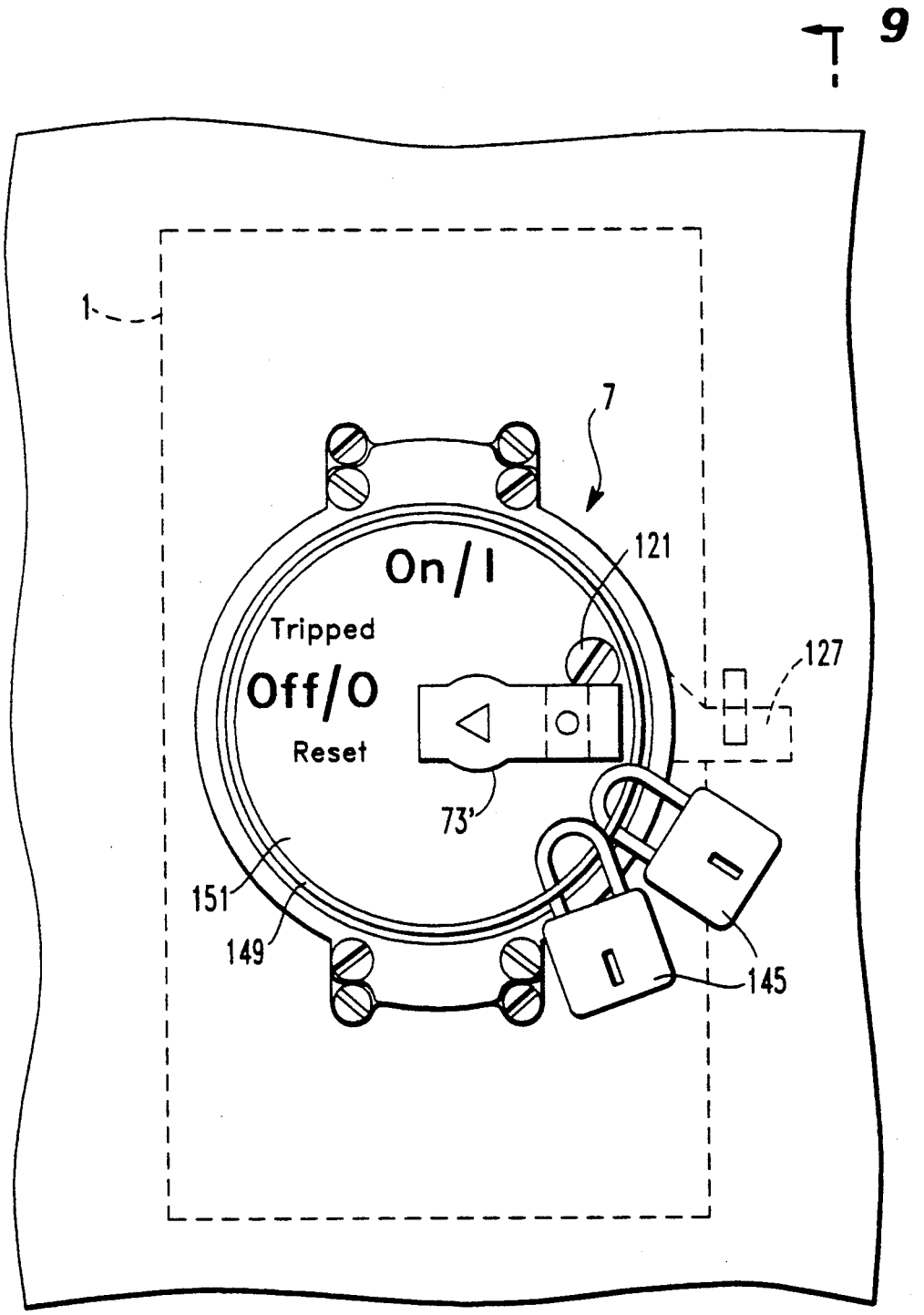
FIG. 8 is a front view of the embodiment of the rotary handle operator of FIG. 7.
Figure 9:
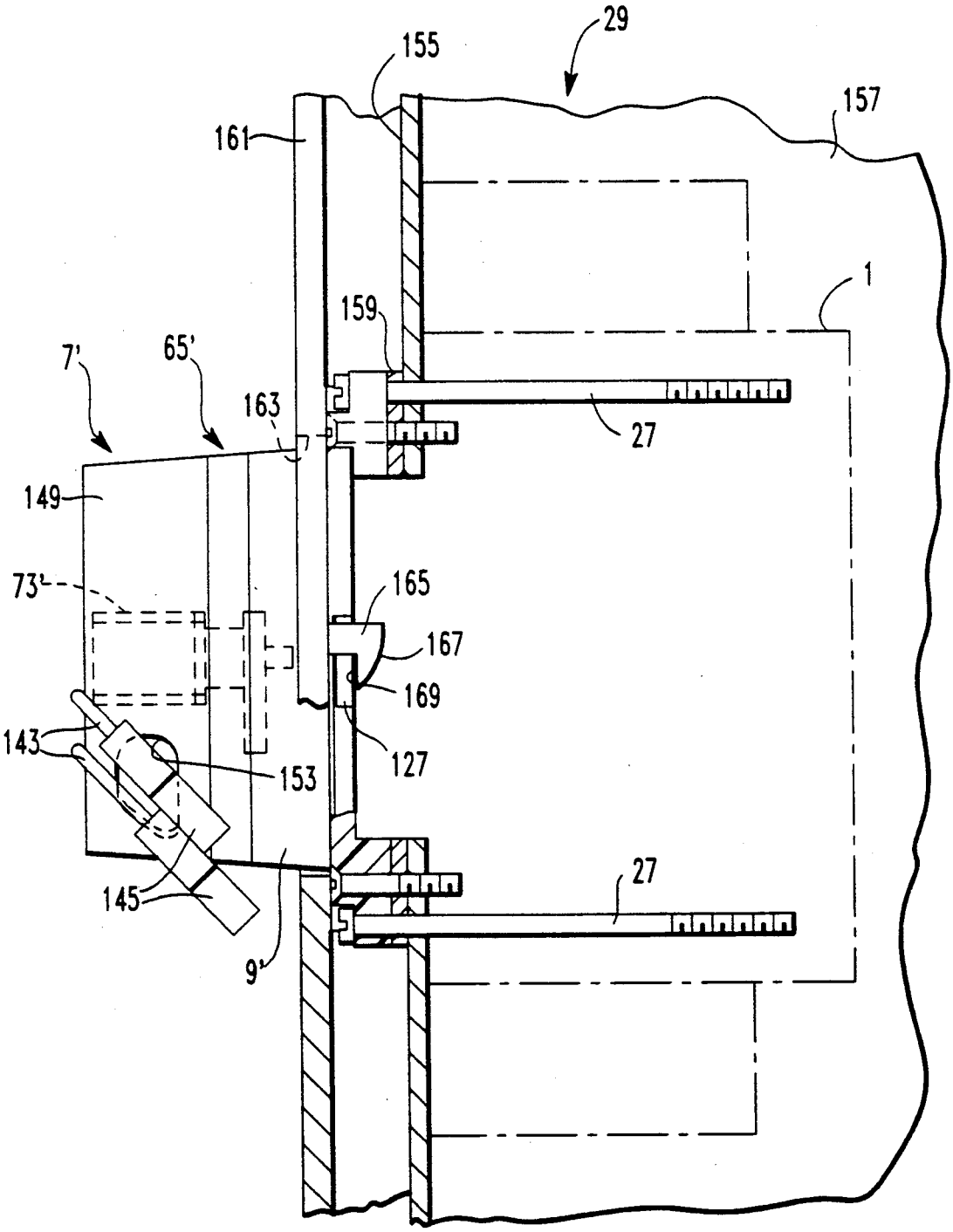
FIG. 9 is a side view of the rotary handle operator of FIGS. 7 and 8 shown installed in a cabinet with parts thereof in section.

Another embodiment of the invention is illustrated in FIGS. 7–9. Parts identical with those of the embodiment shown in FIGS. 1–6 are given the same reference characters. Parts which are similar are given the same reference character primed. This second embodiment of the invention differs in that the cover 65' of the housing 9' of the rotary handle operator 7' has an annular shroud 149 which extends axially outward to form a recess 151 in which the rotating handle 73' can be operated. The shroud 149 has an elongated slot 153 which can receive the shackles 143 of several locks 145. With the locks in place, the shackles 143 prevent rotation of the rotating handle 73' from the off position to the on position. Multiple locks 145 are used, for instance, where concurrence by two people is required to turn the circuit breaker 1 on.

As shown in FIG. 9, the circuit breaker 1 with the rotary handle operator 7' in place, is mounted in an opening in a mounting panel 155 inside a cabinet 157. An optional gasket 159 forms a dust and moisture proof seal for the circuit breaker 1. An additional seal (not shown) would be provided between the shaft 57 and the cover 65'. A door 161 of the cabinet 157 has an opening 163 through which the rotary handle operator 7' projects with the door closed. The housing 9' and the shroud 149 are tapered to accommodate pivoting of the door 161 on its hinges (not shown). The interlock 119 includes a locking dog 165 mounted on the inside of the door 161 adjacent the opening 163.

As further shown in FIG. 9, the locking dog 165 has a camming surface 167 which deflects the spring biased locking lever 127 on the rotary handle operator 7' as the door is closed toward the circuit breaker 1. The locking lever 127 then slides over the hook 169 on the locking dog 165 to prevent opening of the door 161. To release the door, a screwdriver is inserted in a slot in the pin 121 accessible from the face of the rotating handle operator 7' (see FIG. 8) and turned to rotate the locking lever 127 out of engagement with the hook 169 on the locking dog 165.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. In combination, a circuit breaker having a linearly movable operating handle, and a rotary handle operator comprising:

a housing constructed from resin material mounted on said circuit breaker;

a slide member constructed from resin material engaging said operating handle and mounted in said housing for reciprocal movement with said handle along a linear path;

a rotating member constructed from resin material mounted in said housing for rotational movement;

connecting means connecting said rotating member to said slide so that movement of one of said members produces a corresponding movement of the other member;

a rotating handle connected to said rotating member and rotatable therewith between a substantially vertical position with said circuit breaker in the on position and a substantially horizontal position with said circuit breaker in the off position whereby movement of one handle produces a corresponding movement of the other handle; and said slide member and said rotating handle having masses which generate moments about said rotating member which bias said rotating handle towards the horizontal position.

2. The combination of claim 1 wherein said connecting means comprises a rack on said slide member and at least a sector of a pinion gear on said rotating member engaging said rack.

3. The combination of claim 2 wherein said circuit breaker handle is movable linearly in a vertical direction between an upper on position, a lower off position and an intermediate tripped position, and wherein said linear path of said slide is vertical and said rotating member is a rotating shaft mounted substantially horizontally and said handle includes a lever portion extending radially outward from said shaft and rotatable therewith between a vertical position with said circuit breaker handle in the on position and a horizontal position with said circuit breaker in the off position, said slide member and said rotating handle having masses which generate moments about said rotating shaft which bias said rotating handle toward said horizontal position.

4. The combination of claim 2 including locking means which when locked prevents rotation of said rotating handle and therefore linear movement of said circuit breaker handle.

5. The combination of claim 4 wherein said locking means comprises a shroud at least partially surrounding said rotating handle, said shroud having an enclosed slot therein for receiving the shackle of at least one lock and positioned such that said shackle of said at least one lock interferes with rotation of said rotating handle to prevent operation of said circuit breaker.

6. The combination of claim 4 wherein said rotating member comprises a rotating shaft and said rotating handle includes a lever portion extending radially outward from said rotating shaft and said locking means includes a projection extendable from said lever portion and a fixed member engaged by said projection when extended.

7. The combination of claim 6 wherein said locking means includes a locking piece carrying said projection and mounted in said lever portion of said rotating handle for movement between a locked position in which said projection is extended to engage said fixed member and an unlocked position in which said projection is retracted out of engagement with said fixed member, a lock having a hasp, and apertures in said lever portion of said handle through which the hasp of said lock is received to lock said locking piece in the locked position with said projection extended to lock the rotating handle, and therethrough, the circuit breaker handle, from movement.

8. The combination of claim 7 wherein said fixed member comprises a cover on said housing defining an axially extending locking surface, wherein said rotating shaft extends through said cover with said rotating handle rotating over said cover, and wherein said projection is extended axially to overlap said axially extending locking surface.

9. The combination of claim 8 wherein said axially extending locking surface is formed by an aperture in said cover.

10. The combination of claim 1 adapted for use with a cabinet in which said circuit breaker is mounted and having a door with an opening through which said rotary handle operator extends with said door closed, said combination including an interlock mounted in said housing to engage said door and having means to disengage said door when activated.

11. The combination of claim 10 wherein said cabinet has a locking dog with a camming surface leading to a locking shoulder and wherein said interlock comprises a locking lever pivotally mounted in said housing and biasing means resiliently biasing said locking lever to a latched position in which the locking lever slides over said camming surface and engages said locking shoulder with the cabinet door closed, and wherein said means to disengage said door comprises means accessible through the housing of said rotary door operator for rotating said locking lever against said biasing means to disengage said locking lever form said latched position.

12. The combination of claim 1 wherein said resin material has a low coefficient of friction.

13. The combination of claim 12 wherein said connecting means comprises a rack on said slide member and at least a sector of a pinion gear on said rotating member.

14. The combination of claim 13 including locking means which when locked prevents rotation of said rotating handle and therefore linear movement of said circuit breaker handle.

15. The combination of claim 14 wherein said resin material comprises Valox resin.

16. A rotary operator for a circuit breaker having an operating handle linearly movable between an off and on position and an intermediate trip position, said rotary operator comprising:

a housing constructed form resin material mountable on said circuit breaker over said operating handle;

a slide member constructed from resin material engageable with the operating handle and movable along a linear path within said housing, said slide member having a rack extending along said linear path;

a rotating shaft constructed from resin material mounted in said housing for rotation about a longitudinal axis transverse to said linear path;

a pinion gear section constructed from resin material mounted on said rotating shaft and engaging said rack on said slide member;

a rotating handle mounted on said rotating shaft and rotatable therewith between a substantially vertical position with said circuit breaker in the on position and a substantially horizontal position with said circuit breaker in the off position whereby rotation of said rotatable handle results in linear motion of said operating handle and linear motion of the operating handle results in rotary motion of said rotating handle; and said slide member and said rotating handle having masses which generate moments about said rotating shaft which bias said rotating handle towards the horizontal position.

17. The rotary handle operator of claim 16 wherein said housing includes a cover through which said rotating shaft extends and said rotating handle has a hub portion connected to said rotating shaft and a lever portion extending radially outward over said cover, said operator further including locking means in said lever arm portion extendable toward said cover to engage a recess in said cover to prevent rotation of said rotatable handle and therefore linear movement of said operating handle.

18. The rotary handle operator of claim 17 wherein said locking means comprises a locking piece slidable in said lever portion of said rotating handle toward and away from said cover, a spring biasing said locking piece away from said cover, and a locking pin on said locking piece extending toward said cover, said lever portion having apertures through which a lock shackle is extendable to deflect said locking piece toward said cover to engage said locking pin in said recess in said cover.

19. The rotary handle operator of claim 18 wherein said recess in said cover is positioned adjacent said lever portion with said rotating handle in an off position which places said circuit breaker handle in said off position, whereby said circuit breaker may be locked in the off position.

20. The rotary handle operator of claim 16 wherein said rotating handle has a hub portion connected to said rotating shaft and a lever portion extending radially outward from said hub portion, and further including locking means comprising a shroud extending from said housing and at least partially around said rotating handle and having an enclosed slot therein through which at least one lock shackle can be inserted to interfere with the lever portion of said rotating handle to prevent rotation thereof.

21. The rotary handle operator of clam 20 wherein said enclosed slot is positioned in said shroud adjacent an off position of said rotating handle which places said circuit breaker handle in said off position, whereby said circuit breaker handle can be locked in the off position.

22. The rotary handle operator of claim 16 wherein said resin material has a low coefficient of friction.

23. The rotary handle operator of claim 22 wherein said connecting means comprises a rack on said slide member and at least a sector of a pinion gear on said rotating member.

24. The rotary handle operator of claim 23 including locking means which when locked prevents rotation of said rotating handle and therefore linear movement of said circuit breaker handle.

25. The rotary handle operator of claim 24 wherein said resin material comprises Valox resin.

26. In combination, a circuit breaker having a handle linearly movable in a substantially vertical direction between an upper on position, a lower off position, and an intermediate tripped position, and a rotary handle operator comprising:

a housing mounted on said circuit breaker;

a slide member engaging said operating handle and mounted in said housing for reciprocal movement with said handle along a linear path in said vertical direction;

a rotating member rotatably mounted in said housing for rotational movement around a substantially horizontal axis;

connecting means connecting said rotating member to said slide member so that movement of one of said members produces a corresponding movement of said other member;

a rotating handle extending radially outward from said rotating member and rotatable therewith between a substantially vertical position with said circuit breaker in the on position and a substantially horizontal position with said circuit breaker in the off position whereby movement of one handle produces a corresponding movement of said other handle; and said slide member and said rotating handle having masses which generate moments about said rotating member which bias said rotating handle towards the horizontal position.

27. The combination as recited in claim 26 wherein said connecting means comprises a rack on said slide member and at least a sector of a pinion gear on said rotating member.

28. A rotary operator for a circuit breaker having an operating handle linearly movable between an off and on position and an intermediate trip position, said rotary operator comprising:

a housing having a recess mountable on said circuit breaker over said operating handle;

a slide member engageable with said operating handle and movable along a linear path with said housing, said slide member having a rack extending along said linear path;

a rotating shaft mounted in said housing for rotation about an axis transverse to said linear path;

a pinion gear section mounted on said rotating shaft and engaging said rack on said slide member;

a rotating handle mounted on said rotating shaft and rotatable therewith between a substantially vertical position with said circuit breaker in the on position and a substantially horizontal positions with said circuit breaker in the off position whereby rotation of said rotatable handle results in linear motion of said operating handle and linear motion of said operating handle results in rotary motion of said rotating handle;

locking means mounted in said rotating handle and depressible into said recess for preventing rotation of said rotating handle and therefore linear movement of said operating handle;

and said slide member and said rotating handle having masses which generate moments about said rotating shaft which bias said rotating handle towards the horizontal position.

29. The rotary handle operator of claim 28, wherein said locking means comprises a locking piece slidable in said rotating handle toward and away from said housing, a spring biasing said locking piece away from said housing, and a locking pin on said locking piece extending toward said housing, said rotating handle having an aperture through which a lock shackle is extendable for deflecting said locking piece toward said housing whereby said locking pin extends into said recess in said housing.

30. The rotary handle operator of claim 29, wherein said recess in said housing is positioned adjacent said rotating handle when said rotating handle is in a position which correspondingly places said operating handle of said circuit breaker in the off position whereby said circuit breaker may be locked in the off position.

* * * * *